United States Patent [19]

Nishikawa et al.

[11] 4,116,141

[45] Sep. 26, 1978

[54] PLATE SHAPED DEVELOPMENT ELECTRODE

[75] Inventors: Masaji Nishikawa; Yoshiro Suzuki, both of Hachioji; Noboru Takasugi, Higashi-Yamato, all of Japan

[73] Assignee: Olympus Optical Co., Ltd., Tokyo, Japan

[21] Appl. No.: 770,502

[22] Filed: Feb. 18, 1977

[30] Foreign Application Priority Data

Feb. 23, 1976 [JP] Japan ..... 51-17972

[51] Int. Cl.[2] ..... G03G 15/06

[52] U.S. Cl. ..... 118/648; 118/661

[58] Field of Search ..... 118/648, 647, 650, 662, 118/651, 661

[56] References Cited

U.S. PATENT DOCUMENTS

| | | | |
|---|---|---|---|
| 3,435,802 | 4/1969 | Nail | 118/647 |
| 3,822,670 | 7/1974 | Sato et al. | 118/651 X |
| 3,831,556 | 8/1974 | Sato et al. | 118/648 X |
| 3,850,142 | 11/1974 | Jvirblis et al. | 118/647 |
| 3,913,524 | 10/1975 | Fukushima et al. | 118/648 |
| 3,952,702 | 4/1976 | Levy | 118/651 X |
| 3,965,861 | 6/1976 | Fukushima et al. | 118/647 |
| 4,006,709 | 2/1977 | Miyakawa et al. | 118/648 |

*Primary Examiner*—Werner H. Schroeder
*Assistant Examiner*—Andrew M. Falik
*Attorney, Agent, or Firm*—Haseltine, Lake & Waters

[57] ABSTRACT

A device for developing an electrostatic latent image produced on a record sheet by means of electrically charged particles dispersed in a developing liquid. The device comprises at least one pair of developing and squeezing rollers and a plate-shaped perforated fixed electrode. The rollers are arranged in a path along which travelled the record sheet and the fixed electrode is arranged in front and at the rear of the rollers.

5 Claims, 7 Drawing Figures

PLATE SHAPED DEVELOPMENT ELECTRODE

FIELD OF INVENTION

This invention relates to a device for developing an electrostatic latent image produced on a record sheet by means of electrically charged particles dispersed in a developing liquid.

BACKGROUND

If such kind of developing device is constructed that the electrostatic latent image produced on the record sheet is passed through the developing liquid within a short time, there occurs the difficult problem that a sufficiently good development can not be effected, more particularly there occurs an edge effect and the record sheet can not smoothly be fed through the developing liquid.

Attempts have heretofore been made to eliminate such problems. These attempts are mainly divided into the following two measures:

(1) provision is made of a developing electrode and (2) an improved technique is used to supply the developing liquid.

In the first measure, the developing electrode is arranged such that the presence thereof does not prevent the travel of the record sheet, so that the developing electrode is not permitted to come near the record or specifically within 1 mm to 2 mm. As a result, the concentration of a picture image produced on that part of the record sheet which is distant from the edge of the electrostatic charge image by at least several mm becomes low. Such measure, therefore, is not adequate to develop a picture image having a good contrast. In addition, the strength of the electric field directed from the electrostatic latent image produced on the record sheet to the developing electrode is so insufficient and the traveling speed of the record sheet is so low that the developing electrode is not efficient enough to effect a high speed development.

As the second measure, the developing liquid may be agitated or permitted to flow over the record sheet or sprayed as a jet stream against it. In this case, however, the toner particles dispersed in the developing liquid are only moved within that region of the developing liquid which is distant by 20$\mu$ from the electrostatic latent image produced on the record sheet. This second measure, therefore, can not efficiently replenish the developing liquid in a region near the electrostatic latent image produced on the record sheet.

On the basis of the above mentioned two measures, provision has heretofore been made of a developing device comprising a number of pairs of developing and squeezing rollers between which is passed the record sheet and the upper rollers of which function as developing electrodes. In such developing device, if the number of the pairs of the developing and squeezing rollers is increased, the concentration of the picture image developed on the record sheet is raised, thereby effecting development with fidelity. However, if the number of the pairs of the rollers is increased, the number of rotary mechanisms for driving these pairs of rollers must to be increased and, hence, the developing device as a whole becomes expensive.

SUMMARY OF INVENTION

An object of the invention, therefore, is to provide a device for developing an electrostatic latent image produced on a record sheet, which can develop the electrostatic latent image with fidelity without involving the above mentioned difficult problems which have been encountered with the prior art techniques.

According to the invention, there is provided a device for developing an electrostatic latent image produced on a record sheet by means of electrically charged particles dispersed in a developing liquid, comprising at least one pair of developing and squeezing rollers arranged in a path along which travels the record sheet for bringing the electrostatic latent image produced on the record sheet into contact with the developing liquid, and a plate-shaped perforated fixed electrode arranged in front and rear of the pair of developing and squeezing rollers.

BRIEF DESCRIPTION OF DRAWING

The invention will now be described in greater detail with reference to the accompanying drawings, wherein.

DETAILED DESCRIPTION OF DRAWING

Figure 1:
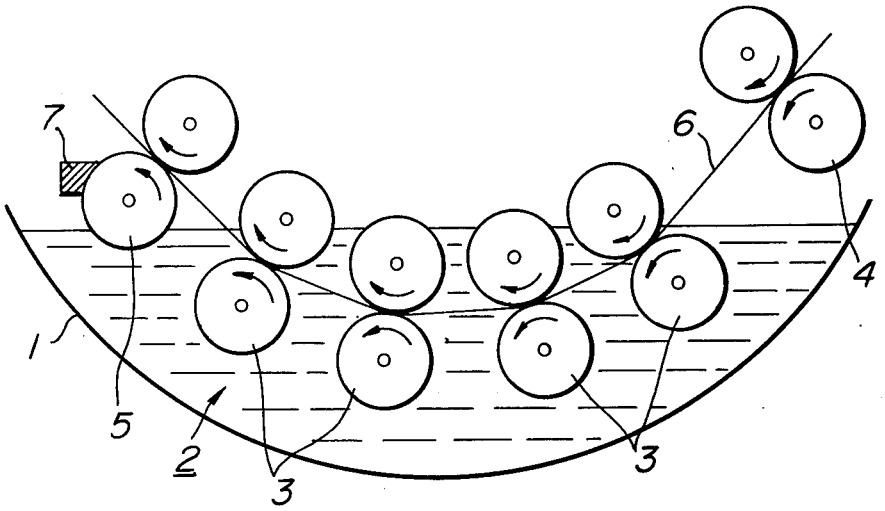
FIG. 1 PRIOR ART
FIG. 1 is a schematic diagram showing a conventional device for developing an electrostatic latent image produced on a record sheet.

In FIG. 1 is shown a prior art developing device which comprises a container 1 containing a developing liquid 2 therein and a number of pairs of developing and squeezing rollers 3 immersed in the developing liquid 2. A record sheet 6 is guided between a pair of delivery rollers 4 arranged at the inlet side of the container 1 into the developing and squeezing rollers 3 and then led out of the container 1 through a pair of additional squeezing rollers 5 arranged at the outlet side of the container 1. Those rollers of the pair of developing and squeezing rollers 3 which are located above the record sheet 6 and which make contact with the recording surface of the record sheet 6 function as developing electrodes. In FIG. 1, reference numeral 7 designates a clean pad which makes contact with the lower roller of the additional squeezing rollers 5 and functions to cleaning out the remaining developing liquid.

The relation between the number of the pairs of the developing and squeezing rollers 3 and the concentration of a picture image developed on the record sheet 6 will now be described. The electric charge on the electrostatic latent image produced on the record sheet 6 eventually becomes completely saturated by the electric charge on the toner particles. Until that time, if the number of pairs of the developing and squeezing rollers 3 is increased, the concentration of the picture image developed on the record sheet 6 is raised. As a result, the use of a larger number of pairs of the developing and squeezing rollers 3 within a certain range insures a development with fidelity. On the contrary, the use of a larger number of the pairs of developing and squeezing rollers 3 provides the drawback that the required number of rotary mechanisms for driving increases, thereby rendering the developing device expensive as a whole.

Figure 2:
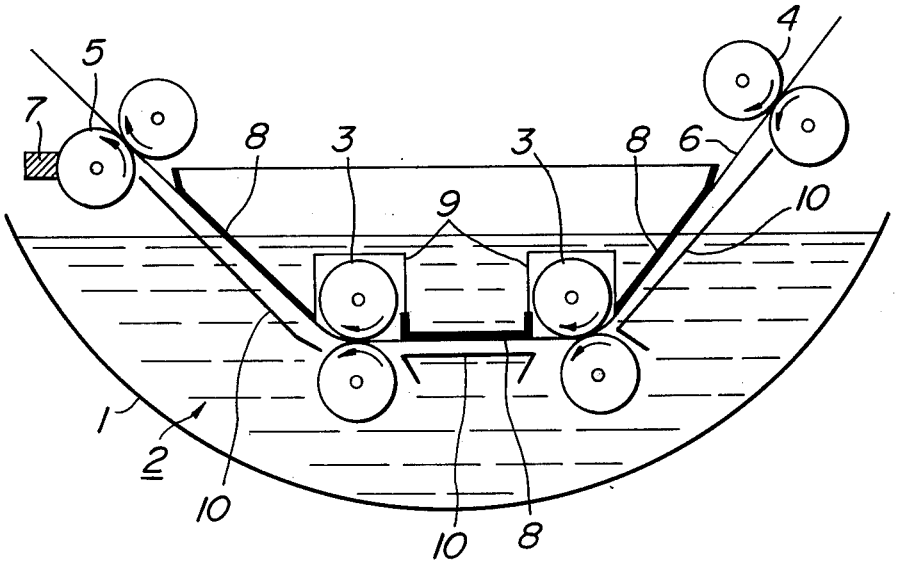
FIG. 2 is a schematic diagram showing a device for developing an electrostatic latent image produced on a record sheet according to the invention.

In FIG. 2 is shown one embodiment of a developing device according to the invention. In the present embodiment, provision is made of only two pairs of developing and squeezing rollers 3 arranged along the path of the record sheet 6 and spaced apart from each other. Between the two pairs of developing and squeezing rollers 3 and at the in front and rear of these rollers 3 are arranged plate-shaped perforated fixed electrodes 8 which are connected with each other by an electric conductive supporting member 9. The electric conductive supporting members are formed of a box-shaped member with its lower side open so as to surround each upper roller with three sides thereof. To respective perforated fixed electrodes 8 are opposed guide plates 10 so as to define a path through which is passed the record sheet 6. Each of these perforated fixed electrodes 8 is formed of a perforated metal sheet for the purpose of supplying the developing liquid 2 therethrough.

Figure 3A:
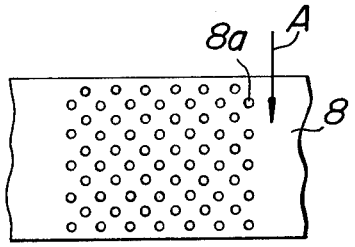
FIG. 3*a* is a partial plan view showing a plate-shaped perforated fixed electrode provided with a number of regularly arranged circular holes and not suitable for use in the present invention.
Figure 3B:
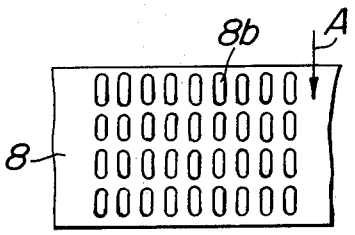
FIG. 3*b* is a partial plan view showing a plate-shaped perforated fixed electrode provided with a number of regularly arranged elongate holes and not suitable for use in the present invention.

In FIG. 3*a* is shown a perforated fixed electrode 8 provided with a number of small circular holes 8*a* and in FIG. 3*b* is shown a perforated fixed electrode 8 provided with a number of elongate holes 8*b*. These circular and elongate holes 8*a* and 8*b* form a regularly distributed pattern with respect to the traveling direction A of the record sheet 6. It has been found that these regularly arranged patterns 8*a*, 8*b* cause the developing liquid 2 to be unevenly supplied therethrough to the record sheet 6. In addition, the perforated fixed electrode 8 provided with such regularly distributed patterns 8*a*, 8*b* functions to unevenly develop the electrostatic latent image produced on the record sheet 6 thus rendering the image or picture developed on the record sheet 6 irregular in concentration and with stripes. As a result, the plate-shaped perforated fixed electrodes 8 shown in FIGS. 3*a* and 3*b* are not suitable for use in the present invention.

Figure 4A:
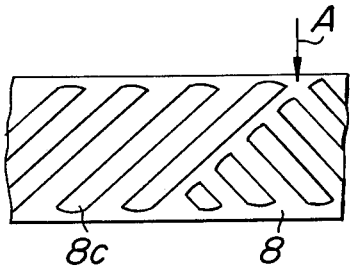
FIGS. 4*a*, 4*b* and 4*c* are partial plan views showing three embodiments of a plate-shaped perforated fixed electrode provided with a number of irregularly arranged elongate hole, and suitable for use in the present invention.

In FIG. 4*a* is shown a plate-shaped perforated fixed electrode 8 provided with elongate holes 8*c* each having a relatively large width. In the present embodiment, one half of the total number of elongate holes 8*c* is inclined at an angle with respect to the traveling direction A of the record sheet 6, but extends in opposite direction relative the other half.

Figure 4B:
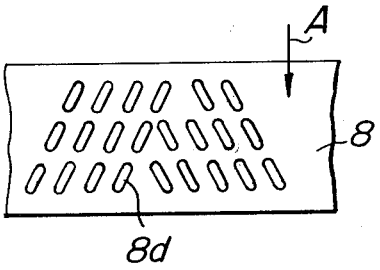

In FIG. 4*b* is shown a modified plate-shaped perforated fixed electrode 8 provided with a number of elongate holes 8*d* each having a relatively small width. In the present embodiment, one half of the total number of elongate holes 8*d* is inclined at an angle with respect to the traveling direction A of the record sheet 6, but extends in opposite direction relative to the other half in the same manner as in the embodiment shown in FIG. 4*a*.

Figure 4C:
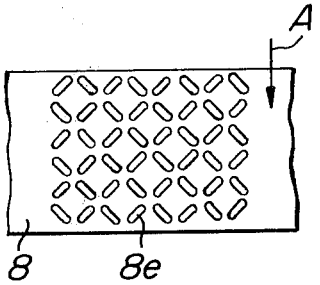

In FIG. 4*c* is shown another modified plate-shaped perforated fixed electrode 8 provided with a number of elongate holes 8*e* all of which are crossed with each other to form a lattice-shaped pattern.

The use of the plate-shaped perforated fixed electrode 8 having elongate holes irregularly inclined at an angle with respect to the traveling direction A of the record sheet 6 as shown by 8*c*, 8*d*, 8*e* in FIGS. 4*a*, 4*b*, 4*c*, respectively, insures a uniform supply of the developing liquid therethrough to the record sheet 6 and causes the plate-shaped perforated fixed electrode 8 to function uniformly thereby preventing the image or picture developed on the record sheet 6 from being subjected to irregular stripe-shaped concentration.

It is preferable that the total sum of areas of the elongate holes 8*c*, 8*d* or 8*e* be 50% of the area of the plate-shaped perforated fixed electrode 8.

The developing device constructed as above described according to the invention has a number of advantages. In the first place, the two pairs of developing and squeezing rollers 3, each pair being arranged between two adjacent plate-shaped electrodes 8, 8 function to remove forcibly a developing liquid layer adhering to the electrostatic latent image produced on the record sheet 6 and containing a small amount of toner which has completed the developing action. Secondly, the record sheet 6 which has passed through the pair of developing and squeezing rollers 3 is subjected to the electrostatic latent image produced thereon and fresh developing liquid is fed through the perforated electrode 8, thus improving the developing efficiency of the developing liquid 2. Third, the pair of developing and squeezing rollers 3 function also as a feeding roller, thereby significantly preventing clogging of the record sheet 6. Fourth, the use of two pairs of developing and squeezing rollers 3 insures a preventing of the edge effect and the reproducing of a good contrast between two adjacent picture images developed on the record sheet 6. Fifth, the insufficient concentration of the picture image developed on the record sheet 6 caused by the use of a small number of pairs of developing and squeezing rollers 3 can fully be compensated by the presence of the plate-shaped perforated fixed electrode 8. Finally, the developing device according to the invention provides an inexpensive means which can develop an electrostatic latent image produced on the record sheet 6 into a picture image having a sufficient concentration, good contrast and the least edge effect without reproducing any electrically charged particle dispersed in the developing liquid 2.

What is claimed is:

1. A device for developing an electrostatic latent image produced on a record sheet, which travels along a path, by means of electrically charged particles dispersed in a developing liquid, comprising at least one pair of developing and squeezing rollers arranged along said path and bringing the electrostatic latent image produced on the record sheet into contact with the developing liquid, said rollers being in contact with the surface of said record sheet, and at least one plate-shaped perforated fixed electrode arranged in front and at the rear of said pair of developing and squeezing rollers, said plate-shaped perforated fixed electrode being provided with a number of elongate holes arranged with respect to the traveling direction of the record sheet, such that one half of the total number of elongate holes is inclined at an angle with respect to the traveling direction of the record sheet and the other half is inclined in the opposite direction.

2. A device according to claim 1, comprising two pairs of said developing and squeezing rollers arranged along said path and bringing the electrostatic latent image produced on the record sheet into contact with the developing liquid and three said plate-shaped perforated fixed electrodes arranged between and in front and at the rear of said pairs of developing and squeezing rollers.

3. A device according to claim 1, comprising, and wherein said plate-shaped perforated fixed electrodes are connected with each other by, an electric conductive supporting member formed of a box-shaped member with an open lower side so as to surround the upper of said rollers with three sides thereof.

4. A device according to claim 1, further comprising a guide plate opposed to said perforated fixed plate to define a path through which is passed the record sheet.

5. A device according to claim 1 wherein the total sum of the areas of said elongate holes is 50% of the area of the plate-shaped perforated fixed electrode.

* * * * *